US006519439B2

(12) United States Patent
Tomita

(10) Patent No.: US 6,519,439 B2
(45) Date of Patent: Feb. 11, 2003

(54) TONER IMAGE FIXING METHOD AND APPARATUS

(75) Inventor: Kunihiko Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/813,218

(22) Filed: Mar. 21, 2001

(65) Prior Publication Data

US 2002/0009315 A1 Jan. 24, 2002

(30) Foreign Application Priority Data

Mar. 21, 2000 (JP) ..... 2000-078338

(51) Int. Cl.[7] ..... G03G 15/20

(52) U.S. Cl. ..... 399/323; 399/324; 399/329; 430/124

(58) Field of Search ..... 399/320, 322, 399/323, 324, 328, 329, 330; 430/124, 99, 109.1

(56) References Cited

U.S. PATENT DOCUMENTS 5,168,315 A * 12/1992 Osawa et al. ..... 399/328
5,499,087 A * 3/1996 Hiraoka et al. ..... 399/329
5,778,294 A * 7/1998 Hiraoka et al. ..... 399/329
5,893,666 A * 4/1999 Aslam et al. ..... 399/329
5,897,249 A * 4/1999 Aslam et al. ..... 399/329
5,956,555 A * 9/1999 Chen et al. ..... 399/329
6,022,661 A * 2/2000 Kurose et al. ..... 430/109.1 X
6,226,488 B1 * 5/2001 Maeyama ..... 399/322

* cited by examiner

*Primary Examiner*—Sandra Brase
(74) *Attorney, Agent, or Firm*—Oblon, Spivak, McClelland, Maier & Neustadt, P.C.

(57) ABSTRACT

A method of fixing a toner image on a support, which includes the steps of heating a toner image formed on a support by use of a toner to the softening point or melting point of the toner or above, using an image fixing member, the toner comprising 100 parts by weight of a resin and at least 0.05 parts by weight of a wax component, the toner having a melt viscosity of 10 to $10^{13}$ centipoise, allowing the toner image to cool or cooling the toner image, and peeling the support which bears the toner image thereon away from the image fixing member when the temperature of the toner image has reached a temperature below the softening point or melting point of the toner, and an image fixing apparatus for carrying out this method is proposed.

8 Claims, 2 Drawing Sheets

TONER IMAGE FIXING METHOD AND APPARATUS

BACKGROUND OF THE INVENTION

1. Field of the Invention

The present invention relates to a toner image fixing method for fixing toner images to a support for use in an electrophotographic image formation apparatus for forming images with toner, such as copying machines, facsimile apparatus and printers. The present invention also relates to an image fixing apparatus using the toner image fixing method.

2. Discussion of Background

In recent years, the demand for rational use of natural resources and energy is increasing for the protection of the global environment. With respect to the electrophotographic image formation apparatus, the development of the technology has tended to be directed to the reduction of power consumption for the rational use of energy, in particular, in the field of image fixing technology. This is because considerable power is consumed in image fixing. Thus, advances have been made in the technology of low-temperature image fixing.

In order to realize the low-temperature image fixing, as a matter of course, the softening point or melting point of the toner has to be lowered. When the softening point or melting point of a thermoplastic resin used in the toner is lowered, the melt viscosity of the resin is inevitably lowered since this is the nature of the thermoplastic resin. The softening point or the melting point of the thermoplastic resin depends upon, for instance, the molecular weight, the molecular weight distribution, the degree of crystallinity, the degree of cross-linking, and the intermolecular force of the resin.

In order to lower the softening point or the melting of a resin with the same structure, the degree of cross-linking has to be lowered or the molecular weight distribution has to be made narrower. There is a lower limit to the molecular weight distribution due to the limit of the preservability of the resin, so that the molecular weight has to be lowered. When the molecular weight is lowered, the molecular weight distribution is narrowed as an inevitable consequence.

Generally, when the molecular weight is lowered, the molecular chains are shortened, so that the tangling of the molecular chains becomes loose. The result is that the melt viscosity of the resin is lowered. When the molecular weight distribution is narrowed, the tangling of the molecular chains also becomes loose, so that the melt viscosity of the resin is lowered. Furthermore, when the degree of intermolecular cross-linking is lowered, the molecules become easy to move individually, so that the melt viscosity of the resin is also lowered.

Even when a toner with such a lowered melt viscosity as mentioned above is used, image fixing can be carried out without causing the so-called offset phenomenon (the phenomenon that a printing medium stays on a film sheet, hereinafter simply referred to as the offset) by use of the methods as disclosed in Japanese Patent Publication 51-29825, Japanese Laid-Open Patent Application 63-118291, Japanese Laid-Open Patent Application 63-118292, and Japanese Laid-Open Patent Application 63-118293.

Japanese Patent Publication 51-29825 discloses an image fixing method comprising the steps of applying heat to a material to be fixed at an image fixing portion comprising a film sheet, cooling the film sheet and the material to be fixed while maintaining the film sheet and the material in close contact, and peeling the film sheet away from the material (toner) when the material has been solidified. In this image fixing method, the concept of forced cooling is included, and there are specifically described a blower and a water cooler for performing the forced cooling.

The image fixing methods described in Japanese Laid-Open Patent Application 63-118291, Japanese Laid-Open Patent Application 63-118292, and Japanese Laid-Open Patent Application 63-118293, have made it possible to perform image fixing on a film, without causing the offset, in a continuous on-machine state, even when a hot-melt printing medium with a low viscosity which comprises wax as the main component is used.

Generally, the printing medium for use in thermal image transfer comprises wax as the main component, and the wax has a viscosity of about 10 to $10^4$ centipoise. Even when the printing medium with such a low viscosity is used, the offset is not caused as long as the above-mentioned methods are used.

More specifically, in the above-mentioned methods, the film sheet is peeled off when the temperature of the fused material is lowered below a top peak of the heat of fusion measured by a differential scanning calorimeter (DSC)

In particular, in Japanese Laid-Open Patent Application 63-118291, the offset is prevented from occurring by forced cooling, which is carried out by blowing air, or by use of water or an olefin gas as cooling medium.

In Japanese Laid-Open Patent Application 63-118292, a film sheet is caused to pass through a cooling section, in close contact with an image transfer material to which a toner image is to be fixed, to prevent the occurrence of the offset, whereby the occurrence of the offset is prevented.

Further, in Japanese Laid-Open Patent Application 63-118293, there is provided a mechanism for peeling the film sheet away from the image transfer material, and also there is provided a mechanism for maintaining the film sheet in close contact with the image transfer material until the film sheet is peeled away from the image transfer material, whereby the occurrence of the offset is prevented.

By these above-mentioned methods, the toner with a lower viscosity than that of conventional toners can be used without the occurrence of the offset.

The above-mentioned methods have no particular problem as long as a conventional toner with a relatively high melt viscosity of more than $10^{13}$ centipoise is used. However, when a toner with a melt viscosity of $10^{13}$ centipoise or less is used, a problem that loud noise is caused by an image fixing member and/or a toner image bearing support is vibrated. This is because when the toner with a melt viscosity of $10^{13}$ centipoise or less is used, the adhesion of the toner to a film-shaped or belt-shaped image fixing member which is trained over a roller is so strong that when image fixing is carried out with the application of heat and pressure to the toner image bearing support, the toner image bearing support sticks to the image fixing member via the toner, and when the image bearing support begins to be separated from the film-shaped or belt-shaped image fixing member, the image fixing member is pulled up to its elastic limit together with the image bearing support, and when the image bearing support is finally separated from the image fixing member, the toner image bearing support and/or the image fixing member is considerably vibrated, making loud noise.

FIG. 3 and FIG. 4 are diagrams in explanation of the above-mentioned problem which is caused when the toner image bearing support is peeled away from the image fixing member.

In FIG. 3 and FIG. 4, reference numeral 1 indicates a heat application and image fixing roller with an inner heater 2 built in. Reference numeral 3 indicates a cooling roller which is rotated together with the heat application and image fixing roller 1 by an image fixing belt 4 which is trained over the heat application and image fixing roller 1 and the cooling roller 3. Reference numerals 5 and 6 respectively indicate counter pressure applications rollers disposed in pressure contact with the heat application and image fixing roller 1 and the cooling roller 3.

With reference to FIG. 3, a sheet of paper P with a toner image made of a toner T formed on a front side thereof which is directed to the image fixing belt 4 is caused to pass between the heat application and image fixing roller 1 and the pressure application roller 5, and is then transported in contact with the image fixing belt 4 toward between the cooling roller 3 and the pressure application roller 6. The sheet of paper P, passing through the nip between the cooling roller 3 and the pressure application roller 5, is suddenly peeled off the image fixing belt 4 at a portion A shown in FIG. 3 the moment the adhesion of the toner T to the image fixing belt 4 exceeds its limit. This peeling of the sheet of paper P away from the image fixing belt 4 is repeated, whereby the sheet of paper P is vibrated, generating the noise.

With reference to FIG. 4, when the sheet of paper P has passed through the nip between the cooling roller 3 and the pressure application roller 6 in the same manner as mentioned above, the image fixing belt 4 is slackened, yielding to the bending strength of the sheet of paper P at a portion A in FIG. 4, and the sheet of paper P is peeled off the image fixing belt 4 the moment the adhesion of the toner T to the image fixing belt 4 exceeds its limit. This peeling of the sheet of paper P away from the image fixing belt 4 is repeated, whereby the sheet of paper P is vibrated, generating the noise.

These problems tend to become conspicuous as the melt viscosity of the toner is lowered.

SUMMARY OF THE INVENTION

It is therefore a first object of the present invention to provide a toner image fixing method from which the above-mentioned conventional problems, which are caused when the toner with a low melt viscosity is used, are eliminated, and which is capable of performing image fixing in a stable manner without generating adverse abnormal vibrations of the image fixing member and/or the toner image bearing support such as a toner image transfer sheet when the toner image bearing support is peeled off the image fixing member, even when a toner with a low melt viscosity is used.

A second object of the present invention is to provide a toner image fixing apparatus for carrying out the above-mentioned toner image fixing method.

The first object of the present invention can be achieved by a method of fixing a toner image on a support, comprising the steps of:

heating a toner image formed on a support by use of a toner to the softening point or melting point of the toner or above, using an image fixing member, the toner comprising 100 parts by weight of a resin and at least 0.05 parts by weight of a wax component, the toner having a melt viscosity of 10 to $10^{13}$ centipoise, allowing the heated toner image to cool or cooling the toner image, and peeling the support which bears the toner image thereon away from the image fixing member when the temperature of the toner image has reached a temperature below the softening point or melting point of the toner.

The second object of the present invention can be achieved by a toner image fixing apparatus for fixing a toner image on a support, the toner image being formed by use of the same toner as mentioned above, comprising:

a pair of image fixing members for transporting therebetween the support which bears the toner image thereon, and heating the toner image to the softening point or melting point of the toner or above, a cooling member for allowing the toner image to cool or cooling the toner image to a temperature below the softening point or melting point of the toner, and a peeling member for peeling the support which bears the toner image thereon from the image fixing members when the toner image has been cooled to a temperature below the softening point or melting point of the toner.

By use of the image fixing apparatus with the above-mentioned structure, even when the above-mentioned toner with a relatively low melt viscosity of 10 to $10^{13}$ centipoise, the wax component works as a release agent, so that the toner image bearing support can be smoothly peeled off the image fixing member, so that there can be controlled the generation of the adverse abnormal vibrations and noise when the toner image bearing support is peeled off the image fixing members.

In the above toner image fixing apparatus, it is preferable that the peeling members be capable of peeling the support away from the image fixing members in a direction with an angle of 10 degrees or more away from the direction in which the support is transported prior to the peeling of the support away from the image fixing members.

By use of the image fixing apparatus with the above-mentioned structure, the toner image bearing support can be smoothly peeled off the image fixing members.

In the above toner image fixing apparatus, at least one of the image fixing members is in the shape of a roller, or in the shape of a belt. When the image fixing member is in the shape of a belt, the belt-shaped image fixing member may be a film- or sheet-shaped belt.

Furthermore, in the above toner image fixing apparatus, at least one of the image fixing members may be an image fixing roller which is capable of applying heat to the toner image to the softening point or melting point of the toner or above, and the cooling member may be a cooling roller, and the toner image fixing apparatus further comprising:

a transportation belt which is trained over the image fixing roller and transports the support which bears the toner image thereon onto the image fixing roller, from which transportation belt the support can be moved away after the support passes over the image fixing roller.

In the image fixing apparatus with the above-mentioned structure, the support, after being heated by the image fixing roller, is no longer heated or receives no restrictions, so that the cooling of the support can be carried out quickly, and therefore the support can be smoothly peeled away from the image fixing member.

Furthermore, in the above toner image fixing apparatus, at least one of the image fixing members may be an image fixing roller which is capable of applying heat to the support which bears the toner image thereon to the softening point or melting point of the toner or above, and the cooling member may be built in the image fixing roller, which is actuated so as to cool the toner image after the application of heat to the toner image by the image fixing roller is terminated.

By use of the image fixing apparatus with the above-mentioned structure, after the toner image bearing support is heated by the image fixing roller, the heat from the image fixing roller can be efficiently cancelled by the cooling roller, so that the cooling of the toner image can be quickly carried out, and accordingly, the support can be smoothly peeled away from the image fixing member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
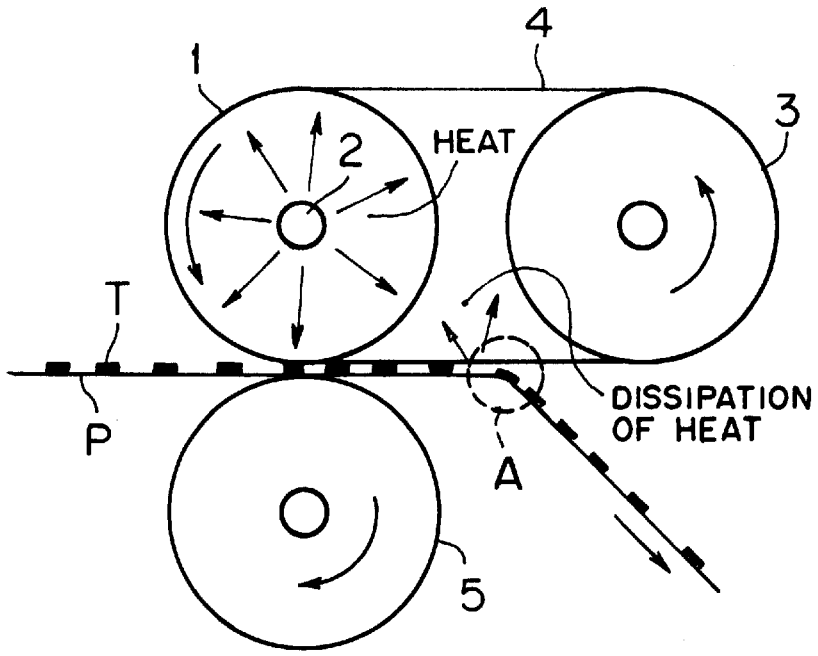
FIG. 1 is a schematic cross-sectional view of a main portion of a first embodiment of the toner image fixing apparatus of the present invention.

In the present specification, the term "melt viscosity" of a material means the melt viscosity of the material at or above the softening point or melting point thereof. The softening point and the melting point respectively correspond to the softening temperature and the flow initiation temperature measured by a commercially available flow tester made by Shimadzu Corporation, and the term "rubber range" means the range from the softening point through the flow initiation temperature.

Generally, even when a thermoplastic resin is heated, the resin is maintained in a solid state before the resin is heated up to its softening point. However, when the resin is further heated to a temperature above the softening point thereof, the resin becomes soft and viscous. When the resin is further heated to a temperature above the melting point thereof, the resin becomes softer and the state thereof is converted into a viscous liquid state. In the thermoplastic resin, the temperature width from the softening point to the melting point, the viscosity in the range of from the softening point to the melting point, and the viscosity above the melting point vary depending upon, for instance, the molecular weight of the resin, the molecular weight distribution of the resin, the degree of crystallinity of the resin, the degree of crosslinking of the resin, and the intermolecular force of the resin. When the structure is the same, the lower the softening point and the melting point, the lower the melt viscosity tends to become.

Therefore, in the present invention, in the case where the melt viscosity of the toner in the temperature range from the softening point through the melting point is more than $10^{13}$ centipoise, and the melt viscosity above the melting point is not more than $10^{13}$ centipoise, the toner is used above the melting point, and when the melt viscosity above the softening point is not more than $10^{13}$ centipoise, the toner is used above the softening point.

In a conventional toner image fixing apparatus, even when the melt viscosity of the toner used is in the range of 10 to $10^{13}$ centipoise, if the structure of the structure of the toner image fixing apparatus is such that the support is peeled away from the image fixing member after the toner image formed on the support has been solidified, the occurrence of hot offset can be prevented. However, the melt viscosity of the toner is so low that the wettability of the image fixing member by the toner is increased when the toner is melted. When the melt toner is solidified, the adhesion of the toner to the image fixing member is enhanced. As a matter of course, after the toner is solidified, the cohesive force of the toner itself is greater than the adhesion of the toner to the image fixing member, so that it is possible to peel the toner away from the image fixing member without causing hot offset. However, the adhesion of the toner to the image fixing member is excessively large, so that the image fixing member and/or the support is pulled excessively by the toner when the toner image bearing support is peeled away from the image fixing member. This causes the support and the image fixing member to easily vibrate and generate the noise when the toner image bearing support is peeled off the image fixing member.

The inventors have made studies, with the above-mentioned conventional problems taken into consideration, and discovered that the abnormal vibrations and noise, which are generated when the toner image bearing support is peeled off the image fixing member in the conventional toner image fixing apparatus, can be controlled by use of a toner image fixing apparatus in which the image fixing member is a roller-shaped, or a film- or sheet-shaped belt, a toner image is formed on a support by transferring the toner to the support to prepare a toner image bearing support, and the toner image bearing support is caused to pass between a pair of the image fixing members, the toner image is heated by the image fixing members to the softening point or melting point of the toner or above to fuse the toner image, the heating of the toner image is then stopped and the toner image is cooled, and when the temperature of the toner image has reached a temperature below the softening point or melting point of the toner, the toner image bearing support is peeled off the image fixing members, even if a toner with a melt viscosity of 10 to $10^{13}$ centipoise is used as long as the toner comprises 100 parts by weight of a resin, and at least 0.05 parts by weight of a wax component.

In order to evaluate the noise level at the time of the peeling of the toner image bearing support from the image fixing member, the following experiments were conducted by use of an image formation apparatus with the toner image fixing apparatus of the present invention was incorporated. The results were as follows:

TABLE 1

| Melt viscosity of toner (cps) | $10^2$ | $10^{12}$ | $10^6$ | $10^{13}$ | $10^{13}$ |
|---|---|---|---|---|---|
| Content of wax component by parts by weight per 100 parts | 3 | 5 | 2 | 0.05 | 0.1 |

TABLE 1-continued

| Melt viscosity of toner (cps) | $10^2$ | $10^{12}$ | $10^6$ | $10^{13}$ | $10^{13}$ |
|---|---|---|---|---|---|
| by weight of resin | | | | | |
| Noise generated at the time of peeling | OK | OK | OK | Accept-able | OK |

In TABLE 1, "OK" denotes that the noise was hardly heard at the time of peeling; and "Acceptable" denotes that the noise was generated, but was tolerable.

TABLE 2

| Melt viscosity of toner (cps) | $10^2$ | $10^{12}$ | $10^6$ |
|---|---|---|---|
| Content of wax component by parts by weight per 100 parts by weight of resin | 0.01 | 0.01 | 0.01 |
| Noise generated at the time of peeling | NG | NG | NG |

In TABLE 2, "NG" denotes that the noise was so loud that it was intolerable.

The results shown in TABLE 1 and TABLE 2 indicate that when the content of the wax component was 0.05 parts by weight or more per 100 parts by weight of resin, the noise generated at the time of peeling was tolerable, and when the content of the wax component was 0.1 parts by weight or more per 100 parts by weight of resin, the level of the noise was so low that the noise was not noticeable.

Furthermore, according to the experiments conducted by the inventors of the present invention, the noise generated at the peeling of the toner image bearing support can be further significantly reduced by setting the peeling angle of the toner image bearing support at an angle of 10 deg or more with respect to the moving direction of the image fixing member, or when a peeling-off portion of the image fixing member is convex toward the toner image bearing support, by setting the angle of a tangent to the convex peeling-off portion at 10 deg or more with respect to the moving direction of the toner image bearing support peeled off the image fixing member.

It is considered that the peeling noise reduction in the image fixing apparatus of the present invention can be achieved by the following mechanism:

In a conventional toner image fixing apparatus in which no silicone oil is used, a wax-dispersed toner is usually used. The peeling action in such a conventional toner image fixing apparatus is different from that in the toner image fixing apparatus of the present invention.

The conventional image fixing process has such a structure that, when the toner is melt and in a rubber range, the toner image bearing support is peeled away from the image fixing member, so that even though the resin in the toner is in such a state that the adhesion thereof is increased, and is apt to adhere to the image fixing member, due to the wettability thereof, a thermally melt wax in an oily state simultaneously moves to the interface of the toner and functions as a liquid release agent in the same manner as silicone oil does. In other words, the adhesion of the toner to the image fixing member is hindered by the liquefied wax which serves as a release agent, since the liquid itself has an extremely small cohesiveness and therefore has a cohesion destroying function to destroy the cohesion of a liquid layer, by causing one portion thereof to depart to the image fixing member and the other portion to depart to the resin of the toner.

In the conventional image fixing process, therefore, a small amount of the wax inevitably remains on the surface of the image fixing member.

Such a conventional toner is usually prepared by kneading a resin, a wax, a pigment and a dye together, so that the pigment and the dye are mixed with the above-mentioned liquefied wax. Therefore, the wax partially remaining on the surface of the image fixing member smears the toner image bearing support. Furthermore, the wax partially remaining on the surface of the image fixing member may also smear a thermistor of the toner image fixing apparatus. When this takes place, there is a risk that the temperature of the toner image fixing apparatus is out of control.

The toner for use in the present invention comprises 100 parts by weight of a resin and at least 0.05 parts by weight of a wax component, and the toner image fixing process of the present invention is such that when the heating of the toner image formed on the support is stopped and the toner image is then cooled to a temperature below the softening point or melting point of the toner, the toner image bearing support is peeled off the image fixing member, so that the toner is cooled and solidified when the toner image bearing support is peeled off the image fixing member. As a matter of course, the wax component, which moved to the interface of the toner, is almost solidified. Therefore, the adhesion of the wax component in a solid state to the toner image fixing member will have to be considered. Generally, the adhesion of the wax component in a solid state to the toner image fixing member is by far smaller than the adhesion of the resin in a solid state to the toner image fixing member, so that the toner image bearing support can be smoothly peeled off the image fixing member, with almost no peeling noise.

The toner image fixing member is made of a highly heat resistant resin with an extremely high degree of crystallinity. In contrast to this, the resin for use in the toner is softened and melt at a relatively low temperature and has a low degree of crystallinity. Therefore, the adhesion of the wax component to the resin used in the toner is greater than the adhesion of the wax component to the resin used in the toner image fixing member. As a result, the cohesion of the wax component in the solid state is sufficiently so high that a wax layer remains on the toner side in its entirety.

Therefore, in the present invention, the wax component does perform the release function in a solid state, not in a liquefied state as in the conventional wax-dispersed, silicone-oil free toner. The wax component used in the present invention works differently from that in the wax used conventionally.

Other features of this invention will become apparent in the course of the following description of exemplary embodiments, which are given for illustration of the invention and are not intended to be limiting thereof.

Figure 2:
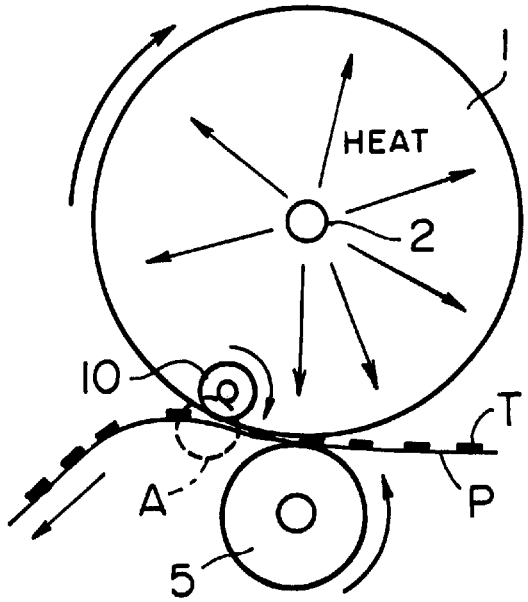
FIG. 2 is a schematic cross-sectional view of a main portion of a second embodiment of the toner image fixing apparatus of the present invention.
Figure 3:
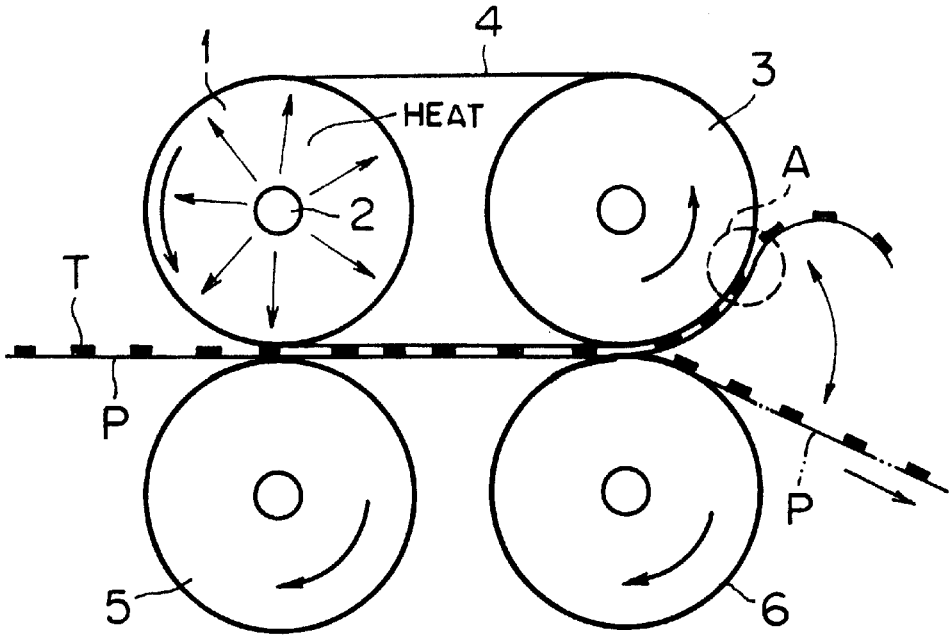
FIG. 3 is a schematic cross-sectional view of a toner image fixing apparatus in explanation of the conventional problems when a toner image bearing support is peeled off an image fixing member.
Figure 4:
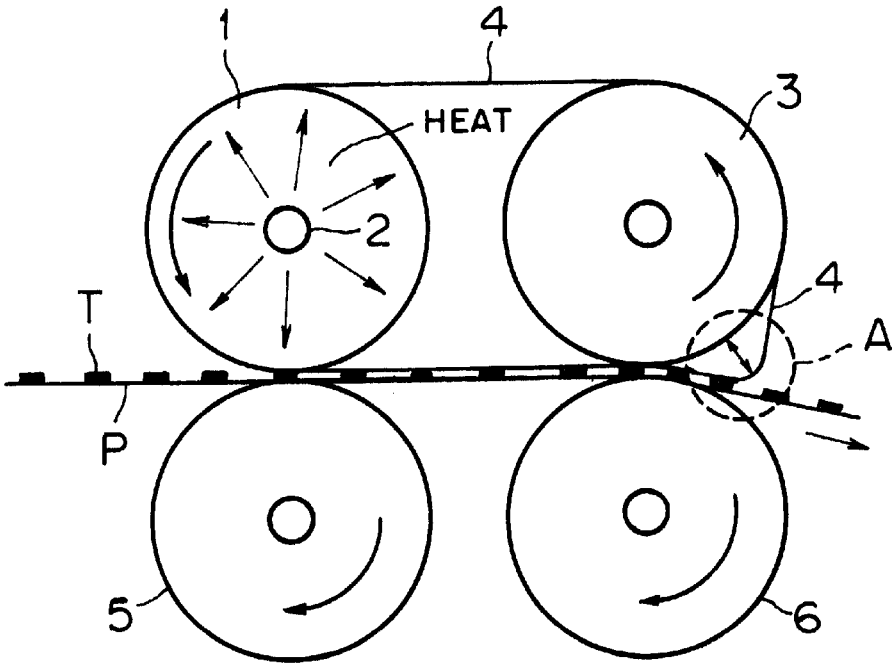
FIG. 4 is a schematic cross-sectional view of another toner image fixing apparatus in explanation of the conventional problems when a toner image bearing support is peeled off an image fixing member.

With reference to FIG. 1 and FIG. 2, two embodiments of the present invention will now be explained. In FIGS. 1 and 2, with respect to the same or corresponding members as in FIGS. 3 and 4, the same reference numbers are used.

FIG. 1 is a schematic cross-sectional view of a main portion of a first embodiment of the toner image fixing apparatus of the present invention. Reference numeral 1 indicates a heat application and image fixing roller with an inner heater 2 built in. Reference numeral 3 indicates a cooling roller which is rotated together with the heat application and image fixing roller 1 by an image fixing belt 4 which is trained over the heat application and image fixing roller 1 and the cooling roller 3. Reference numeral 5 indicates a counter pressure application roller disposed in pressure contact with the heat application and image fixing roller 1.

With reference to FIG. 1, a sheet of paper P with a toner image made of the toner T with the above-mentioned composition formed on a front side thereof which is directed to the image fixing belt 4 is caused to pass between the heat application and image fixing roller 1 and the pressure application roller 5, and is then transported in contact with the image fixing belt 4 toward the cooling roller 3. The sheet of paper P is separated from the image fixing belt 4 after the sheet of paper P has passed through the nip between the heat application and image fixing roller 1 and the pressure application roller 5, so that the sheet of paper P is neither heated any longer nor receives any restrictions after the sheet of paper P is heated under the application of pressure thereto by the heat application and image fixing roller 1 and the pressure application roller 5. Therefore, the sheet of paper P can be allowed to cool or cooled quickly thereafter, and can be easily peeled off the image fixing belt 4 with heat dissipation at a portion A shown in FIG. 1 the moment the adhesion of the wax of the toner T to the image fixing belt 4 exceeds its limit.

When the sheet of paper P is peeled off the image fixing belt 4, the toner T is cooled and sufficiently solidified, and the wax component which has moved to the interface between the toner T and the image fixing belt 4 is almost solidified, and the adhesion of the wax component to the image fixing belt 4 is by far smaller than the adhesion of the solidified toner T to the image fixing belt 4, so that the sheet of paper P can be peeled away from the image fixing belt 4 at the interface with almost no peeling noise.

FIG. 2 is a schematic cross-sectional view of a main portion of a second embodiment of the toner image fixing apparatus of the present invention. Reference numeral 1 indicates a heat application and image fixing roller with an inner heater 2 built in. Reference numeral 5 indicates a counter pressure application roller disposed in pressure contact with the heat application and image fixing roller 1. Reference numeral 10 indicates a cooling roller disposed within the heat application and image fixing roller 1 at an inside wall thereof, near the nip between the heat application and image fixing roller 1 and the pressure application roller 5, on a downstream side of the transporting direction of the sheet of paper P as shown in FIG. 2.

With reference to FIG. 2, the sheet of paper P with a toner image made of the toner T with the above-mentioned composition formed on a front side thereof which is directed to the image fixing belt 4 is caused to pass through the nip between the heat application and image fixing roller 1 and the pressure application roller 5, whereby heat and pressure are applied to the sheet of paper P with the toner image thereon. The sheet of paper P is then transported in contact with the heat application and image fixing roller 1 and is then separated from the heat application and image fixing roller 1 near a portion where the heat application and image fixing roller 1 is cooled by the cooling roller 10. Due to the above-mentioned structure of the toner image fixing apparatus, the sheet of paper P can be quickly cooled, and the sheet of paper P can be easily peeled away from the surface of the heat application and image fixing roller 1 at a portion A shown in FIG. 2 the moment the adhesion of the wax of the toner T to the heat application and image fixing roller 1 exceeds its limit.

When the sheet of paper P is peeled off the surface of the heat application and image fixing roller 1, the toner T is cooled and sufficiently solidified, and the wax component which has moved to the interface between the toner T and the surface of the heat application and image fixing roller 1 is almost solidified, and the adhesion of the wax component to the heat application and image fixing roller 1 is by far smaller than the adhesion of the solidified toner T to the heat application and image fixing roller 1, so that the sheet of paper P can be peeled away from the heat application and image fixing roller 1 at the interface with almost no peeling noise.

In the above embodiments, the roller-shaped heating unit is used for fixing the toner image to the support, but alternatively there can be employed, for example, a belt-shaped heating unit with which an electric linear heat emitting member is in contact, an image fixing belt which emits heat directly therefrom by the application of electric current thereto, and a dielectric heating unit by causing a dielectric current to pass through the toner itself. The present invention is not limited by the choice of particular heating means.

Japanese Patent Application No. 2000-078338 filed Mar. 21, 2000 is hereby incorporated by reference.

What is claimed is:

1. A method of fixing a toner image on a support, comprising the steps of:

heating a toner image formed on a support by use of a toner to the softening point of melting point of said toner or above, using an image fixing member, said toner comprising 100 parts by weight of a resin and at least 0.05 parts by weight of a wax component, the toner having a melt viscosity of 10 to $10^{13}$ centipoise, allowing said toner image to cool or cooling said toner image, and peeling said support which bears said toner image thereon away from said image fixing member when the temperature of said toner image has reached a temperature below the softening point or melting point of said toner at which the wax is substantially solidified.

2. A toner image fixing apparatus for fixing a toner image on a support, said toner image being formed by use of a toner comprising 100 parts by weight of a resin and at least 0.05 parts by weight of a wax component, said toner having a melt viscosity of 10 to $10^{13}$ centipoise, comprising:

a pair of image fixing members for transporting therebetween said support which bears said toner image thereon, and heating said toner image to the softening point or melting point of said toner or above, a cooling member for allowing said toner image to cool or cooling said toner image to a temperature below the softening point or melting point of said toner at which the wax is substantially solidified before a peeling of the toner image from the image fixing members, and a peeling member for peeling said support which bears said toner image thereon from said image fixing members when said toner image is cooled to a temperature below the softening point or melting point of said toner.

3. The toner image fixing apparatus as claimed in claim 2, wherein said peeling member is capable of peeling said support away from said image fixing members in a direction with an angle of 10 degrees or more away from the direction in which said support is transported prior to the peeling of said support away from said image fixing members.

4. The toner image fixing apparatus as claimed in claim 2, wherein at least one of said image fixing members is in the shape of a roller.

5. The toner image fixing apparatus as claimed in claim 4, wherein at least one of said image fixing members is an image fixing roller which is capable of applying heat to said toner image to the softening point or melting point of said toner or above, and said cooling member is a cooling roller, and said toner image fixing apparatus further comprising:

a transportation belt which is trained over said image fixing roller and transports said support which bears said toner image thereon onto said image fixing roller, from which transportation belt said support can be moved away after said support passes over said image fixing roller.

6. The toner image fixing apparatus as claimed in claim 2, wherein at least one of said image fixing members is in the shape of a belt.

7. The toner image fixing apparatus as claimed in claim 6, wherein at least one of said image fixing members is a film- or sheet-shaped belt.

8. A toner image fixing apparatus for fixing a toner image on a support, said toner image being formed by use of a toner comprising 100 parts by weight of a resin and at least 0.05 parts by weight of a wax component, said toner having a melt viscosity of 10 to $10^{13}$ centipoise, comprising:

a pair of image fixing members for transporting therebetween said support which bears said toner image thereon, and heating said toner image to the softening point or melting point of said toner or above, a cooling member for allowing said toner image to cool or cooling said toner image to a temperature below the softening point or melting point of said toner, and a peeling member for peeling said support which bears said toner image thereon from said image fixing members when said toner image is cooled to a temperature below the softening point or melting point of said toner, wherein at least one of said image fixing members is an image fixing roller which is capable of applying heat to said support which bears said toner image thereon to the softening point or melting point of said toner or above, and said cooling member is built in said image fixing roller and is actuated so as to cool said toner image after the application of heat to said toner image by said image fixing roller is terminated.

* * * * *